US006786229B1

(12) United States Patent
Friedlmeier et al.

(10) Patent No.: US 6,786,229 B1
(45) Date of Patent: Sep. 7, 2004

(54) MULTIVESSEL COMPRESSED-GAS TANK SYSTEM AND METHOD OF MAKING SAME

(75) Inventors: Gerardo Friedlmeier, Leinfelden-Echterdingen (DE); Bernd Loeper, Schwaikheim (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/367,973

(22) Filed: Feb. 19, 2003

(30) Foreign Application Priority Data

Feb. 16, 2002 (DE) ..... 102 06 502

(51) Int. Cl.[7] ..... F17C 1/00
(52) U.S. Cl. ..... 137/266; 137/259; 137/899
(58) Field of Search ..... 137/266, 255, 137/259, 899, 351

(56) References Cited

U.S. PATENT DOCUMENTS 4,033,483 A * 7/1977 Neidorf ..... 137/266
4,523,548 A 6/1985 Engel et al.
6,206,027 B1 * 3/2001 Ponnet et al. ..... 137/266
6,588,406 B2 * 7/2003 Oprea ..... 123/525
6,708,719 B2 * 3/2004 Idoguchi ..... 137/266

FOREIGN PATENT DOCUMENTS

DE 35 15 220 10/1986
DE 201 03 682 6/2001

* cited by examiner

*Primary Examiner*—Kevin Lee
(74) *Attorney, Agent, or Firm*—Crowell & Moring LLP

(57) ABSTRACT

A compressed-gas tank system has at least two gas vessels, the gas vessels having a base part and a removal part and openings which are assigned to the removal parts. The removal parts of the gas vessels are directly connected to a connecting rail, without any pipelines therebetween. The openings are in communication with a gas passage which runs inside the connecting rail, the connecting rail being assigned a shut-off valve which is common to all the gas vessels. The gas vessels are mechanically connected to a supporting rail, the supporting rail and the connecting rail forming a holding frame for the gas vessels.

21 Claims, 1 Drawing Sheet

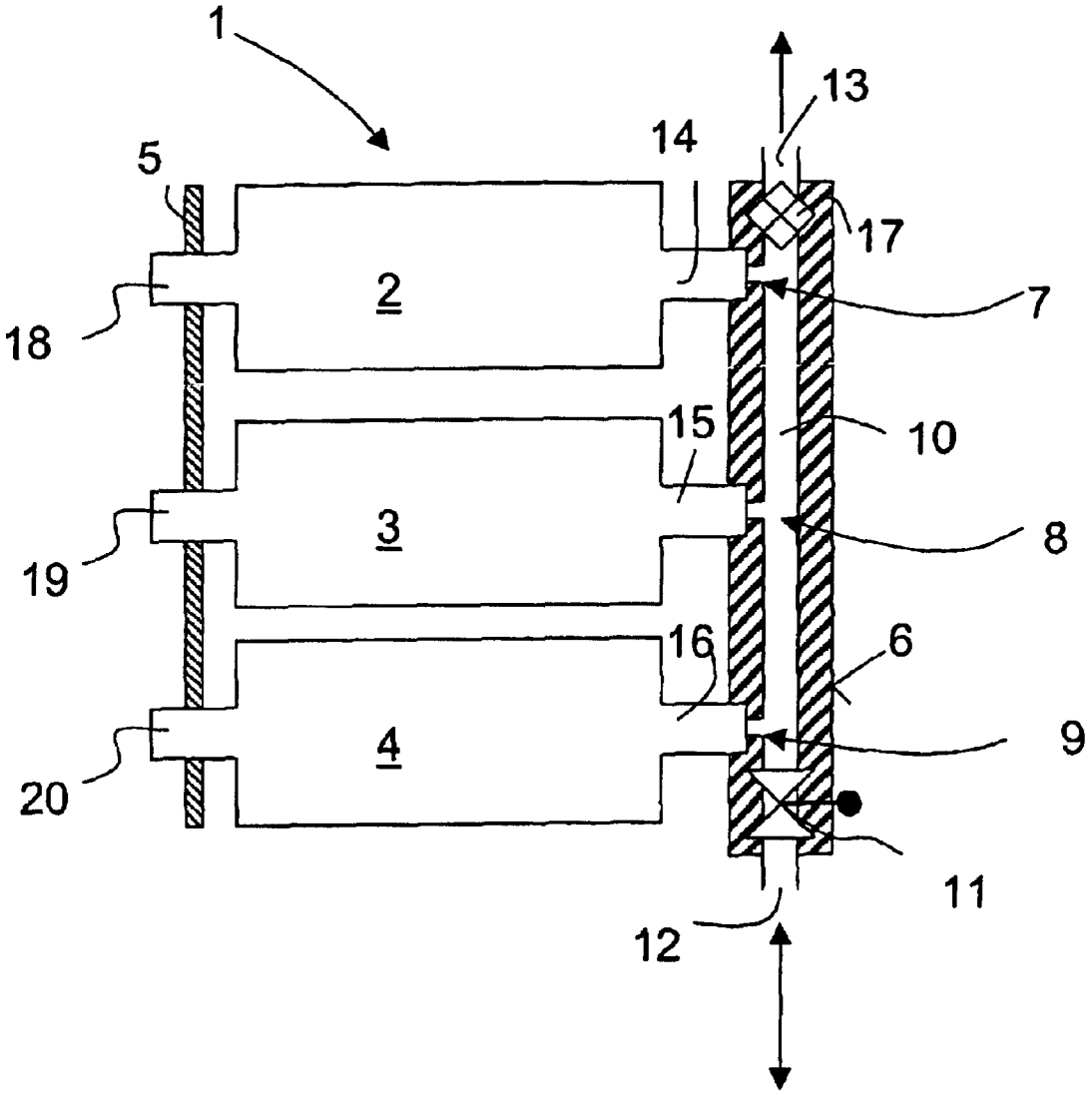
1
13
14
5
17
2
7
18
15
10
3
8
19
16
6
4
9
20
11
12

MULTIVESSEL COMPRESSED-GAS TANK SYSTEM AND METHOD OF MAKING SAME

BACKGROUND OF THE INVENTION

This application claims the priority of German application No. 102 06 502.0, filed Feb. 16, 2002 the disclosure of which is expressly incorporated by reference herein.

The invention relates to a compressed-gas tank system having at least two gas vessels.

It is known to store and transport compressed gases in gas cylinders. The gas cylinder vessels, which are, for example, cylindrical, are filled with a gas which is at a pressure which is higher than ambient pressure. The gas cylinders usually have a shut-off valve on one side, and, by way of example, a pressure regulator can be connected to the shut-off valve and used to remove the gas from the cylinder and reduce its pressure to a desired removal pressure. There is usually also a safety device comprising a fusible safety feature, which opens when the tank reaches an unacceptable excess temperature, allows the pressure to be reduced and therefore protects against excess pressure. If relatively large quantities of gas are required, gas cylinders of this type are, for example, connected in series.

If motor vehicle equipment is to be supplied with compressed gas on board, it is necessary for it to be possible to carry a sufficient quantity of the gas in the vehicle. In the case of multivessel compressed-gas tank systems, it is necessary for the plurality of vessels to be connected to one another, which leads to leakage problems and to high costs on account of the complexity of the system.

German Patent Document DE 201 03 682 U1 has disclosed a gas assembly station, comprising a number of compressed-gas cylinders, which are arranged in a container and are connected to one another by means of high-pressure lines. The common high-pressure outlet of the compressed-gas cylinders can be closed by means of a valve.

German Patent Document DE 35 15 220 A1 (U.S. Pat. No. 4,523,548) has disclosed a compressed-gas tank system of the generic type in which a plurality of compressed-gas tanks are connected, in each case via a valve, to a distributor for the compressed gas. In addition, there is a frame having in each case one frame element assigned to the base part and one frame element assigned to the removal part of the compressed-gas cylinders in order to hold a plurality of compressed-gas cylinders.

The invention is based on an object of providing a multivessel compressed-gas tank system which is suitable for supplying a vehicle with compressed gas and which, despite having a simplified structure, satisfies the requirements with regard to safety in the event of a crash.

This object is achieved according to certain preferred embodiments of the invention by a compressed-gas tank system having at least two gas vessels, the gas vessels having a base part and a removal part as well as openings which are assigned to the removal parts, having a connecting rail, which connects the removal parts to one another, the openings being in flow communication with a gas passage which runs inside the connecting rail, and the gas vessels being mechanically connected to a supporting rail, wherein a shut-off valve, which is common to all the gas vessels, is arranged at a first gas-passage outlet of the connecting rail, wherein removal parts are connected to the connecting rail without any pipelines being connected therebetween, and wherein the supporting rail and the connecting rail form a holding frame for the gas vessels.

One advantage of the solution according to the invention consists in the fact that the compressed-gas tank system represents a device which is suitable for mass production, which is desirable in particular for use in vehicles. The device also has a reduced likelihood of leaks, which is of benefit both with regard to safety and with regard to environmental aspects. Furthermore, the device according to the invention allows lower costs, since it is able to make do with a reduced number of expensive shut-off valves. The device can also easily be extended to encompass a different number of gas vessels. Moreover, the structure of the system is simplified, since a connecting rail connects a plurality of gas vessels in terms of flow and, at the same time, together with a further supporting rail, serves to form a holding frame for the gas vessels.

The provision of a connecting rail with a common shut-off valve also makes it possible to provide a common pressure-relief safety feature in the form of a fusible safety feature arranged at the connecting rail.

Arranging the gas vessels in parallel makes it possible to form a holding frame in a simple way. Arranging the supporting rail in the region of the base parts of the gas vessels results in a structure which is as stable as possible.

Suitably matching the material thickness and length of the connecting rail in such a manner that the connecting rail and the attachment to the gas vessels have at least the same mechanical stability and impact strength as an individual gas vessel of the same volume ensures a higher level of variability in the arrangement while, at the same time, ensuring that the arrangement is safe in the event of a crash. In this case, the multivessel compressed-gas tank system satisfies the same test requirements as a large single-tank system.

A suitable connecting rail with a high level of stability can preferably be produced by casting.

It will be understood that the abovementioned features and those which are still to be explained below can be used not only in the combination given in each instance but also in other combinations or on their own without departing from the scope of the present invention.

Further advantages and configurations of the invention will emerge from the claims and from the description.

Other objects, advantages and novel features of the present invention will become apparent from the following detailed description of the invention when considered in conjunction with the accompanying drawings.

BRIEF DESCRIPTION OF THE DRAWINGS

The single drawing FIGURE shows a diagrammatic plan view of a preferred configuration of the system according to the invention.

DETAILED DESCRIPTION OF THE DRAWINGS

The compressed-gas tank system 1 according to the invention has at least two gas vessels 2, 3, 4, it being possible for the individual gas vessels 2, 3, 4 to be of different shapes, although they are preferably of substantially identical design. The gas vessels 2, 3, 4 are preferably cylindrical, but may also have other shapes, and at one end have a base part 18, 19, 20, and at the other end have a removal part 14, 15, 16. The removal parts 14, 15, 16 are assigned openings 7, 8, 9, from which gas can be removed or through which the gas vessels 2, 3, 4 can be refilled with gas. The openings 7, 8, 9 of the removal parts 14, 15, 16 project into a connecting rail 6 which connects the removal parts 14, 15, 16 to one another, the openings 7, 8, 9 being in communication with a gas passage 10 which runs in the connecting rail 6. Alternatively, the connecting rail 6 may have precurvatures (not shown) which project into the removal parts 14, 15, 16. Flange-like fittings are also contemplated.

According to the invention, the gas vessels 2, 3, 4 or the removal parts 14, 15, 16 are assigned a common shut-off valve 11, a single shut-off valve 11 being provided both in order to shut off the connecting rail 6 and to shut off the gas vessels 2, 3, 4. The shut-off valve 11 is assigned to a first gas-passage outlet 12 of the connecting rail 6 and shuts off this outlet 12. The gas is fed out of the gas vessels 2, 3, 4 to a consumer through the gas-passage outlet 12. It is also possible for individual gas vessels 2, 3, 4 to have additional shut-off valves, expediently if there is a relatively large number of individual vessels. However, it is always possible for all the gas vessels 2, 3, 4 assigned to a connecting rail 6 to be shut off by a common shut-off valve 11 arranged in the connecting rail 6.

The connecting rail 6 may additionally be assigned a safety device, preferably a fusible safety feature 17, at a second gas-passage outlet 13, which can preferably also act as a common excess-temperature safety feature for the gas vessels 2, 3, 4. In this case too, it is also possible for some or each of the gas vessels 2, 3, 4 additionally to be provided with a separate fusible safety feature 17.

The gas vessels 2, 3, 4 are connected in a positively locking manner to the connecting rail 6, for example by screw connection, it being possible for sealing means (not shown in more detail) for example O-rings, to be provided between the removal part 14, 15, 16, the gas vessels 2, 3, 4 and the connecting rail 6 or the gas passage 10.

It is preferable for the gas vessels 2, 3, 4 to be arranged parallel to one another. The gas vessels 2, 3, 4 are connected to a supporting rail 5, which is particularly preferably arranged in the region of the base parts 18, 19, 20. The supporting rail 5 and the connecting rail 6 form a holding frame for the gas vessels 2, 3, 4.

When used in a vehicle, the device is preferably fitted in a region of the vehicle which is substantially protected against the effect of crash forces.

It is preferable for the connecting rail 6 to be formed from a cast metal part in which the gas passage 10 is integrated. This imparts particularly high stability to the connecting rail 6 and minimizes connections which are prone to leaks.

It is particularly preferable for the material thickness, diameter and length of the connecting rail 6 to be matched to one another in such a way that the connecting rail 6 has at least the same mechanical stability and impact strength as an individual gas vessel 2, 3, 4. This makes it possible to ensure that the same safety demands which are imposed on individual gas vessels 2, 3, 4 are also satisfied by the connecting rail 6 and therefore by the entire compressed-gas tank system 1.

The device according to the invention, on account of the mechanical and gas-flow connection of gas vessels 2, 3, 4 and connecting rail 6, is of such rigid and stable design that the entire compressed-gas system 1 with just a single shut-off valve 11 and if appropriate with just a single fusible safety feature 17 is at least as stable as an individual vessel of the same volume. The device allows a rigid mechanical and gas-flow connection, which is optimized for mass production, between gas vessels of multivessel compressed-gas systems.

Since only a few connections or threaded joints are required, the likelihood of leaks is considerably, lower than with standard threaded pipe connections, in which the individual vessels have to be connected to one another using a large number of expensive fittings. The costs of the system are reduced, since a single shut-off valve 11 is sufficient for each tank system and it is not necessary for each individual gas vessel 2, 3, 4 to be provided with an expensive shut-off valve 11. The integration of gas vessels 2, 3, 4 in a compressed-gas tank system 1 is also simplified. The system can easily be adapted to a different number of gas vessels 2, 3, 4.

It is expedient for additional struts, which are preferably able to absorb impact, shear and torsional forces which are greater than or equal to those which act on the positively locking connections between the gas vessels 2, 3, 4 and the connecting rail 6 and/or the supporting rail 5, to be arranged at and/or between supporting rail 5 and connecting rail 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. Compressed-gas tank system comprising:

at least two gas vessels, the gas vessels having a base part and a removal part as well as openings which are assigned to the removal parts, a connecting rail, which connects the removal parts to one another, the openings being in flow communication with a gas passage which runs inside the connecting rail, and a supporting rail, the gas vessels being mechanically connected to the supporting rail, wherein a shut-off valve, which is common to all the gas vessels, is arranged at a first gas-passage outlet of the connecting rail, wherein the removal parts are connected to the connecting rail without any pipelines being connected therebetween, and wherein the supporting rail and the connecting rail form a holding frame for the gas vessels.

2. Compressed-gas tank system according to claim 1, wherein the connecting rail is assigned a fusible safety feature at a second gas-passage outlet, which forms a common fusible safety feature of the gas vessels.

3. Compressed-gas tank system according to claim 1, wherein the gas vessels are arranged parallel to one another.

4. Compressed-gas tank system according to claim 1, wherein the supporting rail is arranged in a region of the base parts of the gas vessels.

5. Compressed-gas tank system according to claim 1, wherein the material thickness and length of the connecting rail are matched to one another in such a way that the connecting rail and the attachment to the gas vessels have at least the same mechanical stability and impact strength as an individual gas vessel of the same volume.

6. Compressed-gas tank system according to claim 1, wherein the connecting rail is formed from a cast metal part with an integrated gas passage.

7. Compressed-gas tank system according to claim 1, wherein struts, which absorb impact, shear and torsional forces which are equal to or greater than those which are acting on the positively locking connections between the gas vessels and the connecting rail and/or the supporting rail, are arranged at and/or between the supporting rail and connecting rail.

8. Compressed-gas holding system comprising:

a plurality of gas vessels which each have a removal part with an outlet opening, a connecting rail which in use is mechanically connected to removal parts of the respective gas vessels to outlet openings with respective of the gas vessels in flow communication with a gas passage running inside the connecting rail, and a shut-off valve which is common to all gas vessels and is arranged at a first gas passage outlet of the connecting rail, wherein the removal parts are directly connected in use to the connecting rail without any pipelines connected between the removal parts and the connecting rail.

9. Compressed gas holding system according to claim 8, comprising a supporting rail which together with the connecting rail forms a holding frame for the compressed gas vessels.

10. Compressed gas holding system according to claim 8, wherein the connecting rail is assigned a fusible safety feature at a second gas-passage outlet, which forms a common fusible safety feature of the gas vessels.

11. Compressed gas holding system according to claim 9, wherein the connecting rail is assigned a fusible safety feature at a second gas-passage outlet, which forms a common fusible safety feature of the gas vessels.

12. Compressed gas holding system according to claim 8, wherein the gas vessels each have a base part disposed at a spacing from the removal part.

13. Compressed gas holding system according to claim 12, comprising a supporting rail which together with the connecting rail forms a holding frame for the compressed gas vessels.

14. Compressed gas holding system according to claim 13, wherein in use the gas vessels are arranged parallel to one another with said base parts mechanically supported at the supporting rail.

15. Compressed gas holding system according to claim 14, wherein the material thickness and length of the connecting rail are matched to one another in such a way that the connecting rail and the attachment to the gas vessels have at least the same mechanical stability and impact strength as an individual gas vessel of the same volume.

16. Compressed gas holding system according to claim 15, wherein the connecting rail is formed from a cast metal part with an integrated gas passage.

17. Compressed gas holding system according to claim 15, wherein struts, which absorb impact, shear and torsional forces which are equal to or greater than those which are acting on the positively locking connections between the gas vessels and the connecting rail and/or the supporting rail, are arranged at and/or between supporting rail and connecting rail.

18. Compressed gas holding system according to claim 16, wherein struts, which absorb impact, shear and torsional forces which are equal to or greater than those which are acting on the positively locking connections between the gas vessels and the connecting rail and/or the supporting rail, are arranged at and/or between supporting rail and connecting rail.

19. Compressed gas holding system according to claim 8, wherein said connecting rail is supported at a vehicle which has equipment which in use consumes gas carried by said gas vessels.

20. A method of making a gas holding system according to claim 8, comprising forming the connecting rail by casting.

21. A motor vehicle including motor vehicle equipment which in use is supplied with compressed gas and a compressed gas holding system for compressed gas to be supplied to said motor vehicle equipment, said compressed gas holding system comprising:

a plurality of gas vessels which each have a removal part with an outlet opening, a connecting rail which in use is mechanically connected to removal parts of the respective gas vessels to outlet openings with respective of the gas vessels in flow communication with a gas passage running inside the connecting rail, and a shut-off valve which is common to all gas vessels and is arranged at a first gas passage outlet of the connecting rail, wherein the removal parts are directly connected in use to the connecting rail without any pipelines connected between the removal parts and the connecting rail.

* * * * *